United States Patent [19]

Quinn et al.

[11] 4,038,594

[45] July 26, 1977

[54] DISTORTIONLESS SINE WAVE AMPLIFICATION

[75] Inventors: Halsey P. Quinn, Rancho Palos Verdes; Donald B. Levinson, Beverly Hills, both of Calif.

[73] Assignee: Xerox Corporation, Stamford, Conn.

[21] Appl. No.: 617,111

[22] Filed: Sept. 26, 1975

[51] Int. Cl.[2] ..... G05F 1/44

[52] U.S. Cl. ..... 323/4; 323/6; 323/21; 361/225

[58] Field of Search ..... 250/324; 317/262 A; 321/2, 18, 19, 45 R; 323/4, 6, 7, 20, 21, 24, 44 R, 62

[56] References Cited

U.S. PATENT DOCUMENTS

| | | | |
|---|---|---|---|
| 3,253,209 | 5/1966 | Hordosi | 321/18 |
| 3,564,444 | 2/1971 | Walsh | 323/4 UX |
| 3,621,284 | 11/1971 | Cluett et al. | 323/21 UX |
| 3,701,937 | 10/1972 | Combs | 321/2 |
| 3,745,411 | 7/1973 | Polman et al. | 323/24 X |
| 3,819,942 | 6/1974 | Hastwell et al. | 317/262 A |

*Primary Examiner*—A. D. Pellinen

*Attorney, Agent, or Firm*—James J. Ralabate; Franklyn C. Weiss; Ronald L. Taylor

[57] ABSTRACT

A power supply circuit for generating true sine wave signals by regulating the average value of the signal, whereby the RMS value of the signal is regulated accordingly. By monitoring the circuit through the load, represented by a monitored voltage value, a feedback network is coupled to a variable resistor in conjunction with other circuitry to maintain a constant voltage ratio to the power transformer assuring a properly shaped wave at a larger or smaller variation.

8 Claims, 4 Drawing Figures

DISTORTIONLESS SINE WAVE AMPLIFICATION

BACKGROUND OF THE INVENTION

This invention relates to a circuit for controlling the characteristics of the electrical current to any load requiring sinusoidal waveforms at any power level. One such application is for AC corotrons used in commercial xerographic machine hardware.

Historically, such AC corotrons have been supplied from a constant voltage transformer operated in an overloaded condition and controlled with a shunt regulator. This provides a variable amplitude sine wave which can be electrically controlled. This has been done commercially in the past in both the model 3100 and 4000 xerographic processors manufactured and marketed by Xerox Corporation. The constant voltage transformer is a relatively expensive item as is the power supply.

Another prior art type of power supply involved a series pass transistor in the primary winding of a standard transformer. This greatly reduces the cost of a given output bit it distorts the sine wave greatly by effectively chopping off the upper parts of the waves. This could create a problem in xerographic machines since these machines are typically RMS sensitive to a wave shape rather than to the amplitude of a wave. Thus, the clipping off of the top of the wave changes the RMS to average ratio. But since power supplies most easily recognize the average value of a wave, there are problems in making the RMS value track with the average value of the output of the power supply. Therefore, the regulation that is apparent to the machine is not as good as if a good sine wave had been utilized.

OBJECTS OF THE INVENTION

It is, therefore, an object of the present invention to provide a true sine wave signal power supply.

It is another object of the present invention to provide a power supply for the generation of a true sine wave signal by regulating the average value of the output signal and thus its RMS value.

It is another object of the present invention to provide a variable resistance which responds to current through the load by use of a feedback network so as to ensure the generation of a true sine wave.

It is another object of the present invention to provide a true sine wave signal power supply for a corotron by the use of a feedback network coupled to an electrically responsive variable resistance so as to effectively vary the driving current to the corotron.

SUMMARY OF THE INVENTION

According to the instant invention, the prior art series pass transistor in the primary circuit of a standard transformer, or the constant voltage transformer, is replaced with a device which performs like a variable resistor. In this manner, as the voltage changes across the device, the current will change linearly so that there is no distortion of the sine wave. Furthermore, this device can be electrically controlled to vary the apparent value of the resistance. It is, therefore, possible to generate a true sine wave output which will satisfy the machine requirements. This is done by regulating the average value and having the RMS value follow as a constant ratio.

DESCRIPTION OF THE DRAWINGS

For a more complete understanding of the invention, as well as other objects and further features thereof, reference may be had to the following detailed description of the invention in conjunction with the drawings wherein:

FIG. 2A shows one alternative embodiment of resistance R2 of FIG. 1 utilizing a light emitting element and a light sensitive resistive device; while

DETAILED DESCRIPTION OF THE INVENTION

Figure 1:
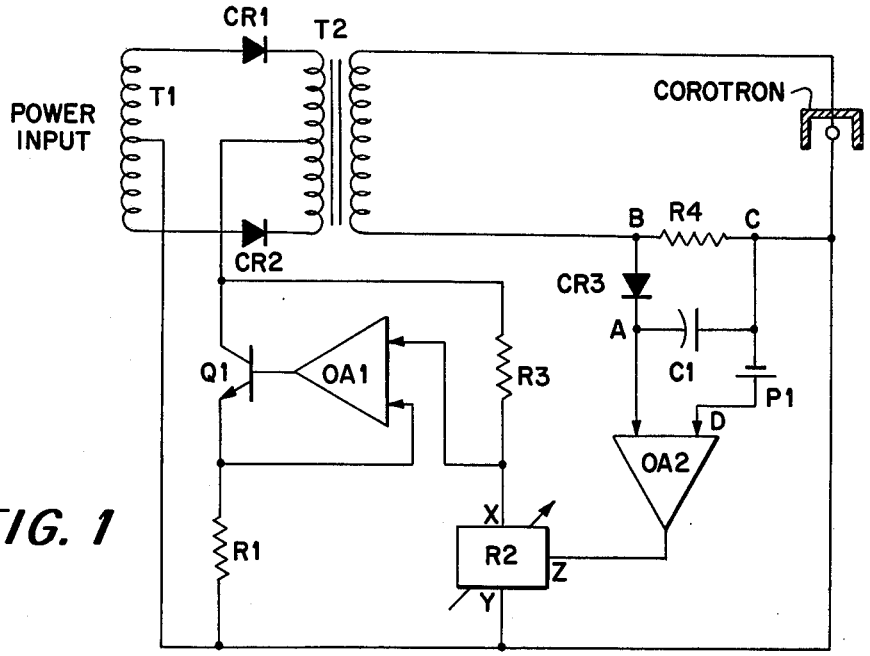
FIG. 1 is a schematic diagram showing the circuit details of the present invention.

The circuit, which is shown in FIG. 1 as illustrative of the invention, includes a series pass transistor Q1, a resistor R1 in series with the transistor to sense the current, and a resistor divider R3, R2 across the transistor to sense the voltage. There is also an operational amplifier OA1 which forces the ratio of voltage across R1 and the voltage across the lower part of the divider, R2, to be constant or equal to each other. Because of this, if the current through R1 should increase the voltage across R1, for any reason, the operational amplifier OA1 will cause the transistor Q1 to turn off slightly to increase the amount of voltage across itself and increase the voltage across the R3, R2 combination which will then restore the voltage across R2 equal to the voltage across R1. Effectively, the voltage is being forced to be N times the current and since E over I is a constant, E over I equalling R by definition, R is a constant. Therefore, the properly shaped wave will always be obtained at a larger or smaller variation. The effect is to cause a constant resistance in response to changes of source voltage.

To change the value of the wave magnitude, either a light dependent resistor, or a field effect transistor can be utilized which can look like a resistor when there are very low values of voltage across it. This will cause the ratio of R3 to R2 to change. As the ratio of R3 over R2 becomes greater, the voltage across the transistor has to be greater for a given amount of current. As R2 becomes smaller, the R3 to R2 ratio will become greater, the voltage across transistor Q1 will thus become greater for the same current from input power transformer T1. Since R is equal to E over I by definition, the resistance has effectively increased so we can control the effective value of resistance by electrically adjusting the value of R2. This is done by sensing any error in the output voltage at the corotron and feeding back a signal to the resistor element R2.

The error factor is sensed by a resistor R4 in series with the corotron load. The voltage across the resistor is a function of the output current to the corotron. This voltage is compared to a reference voltage, indicated as battery P1, and by feedback around the whole loop, the voltage across resistor R4 must be equal to the reference voltage P1. In other words, the reference resistor R4 determines what the controlled charging corotron is receiving and then by modifying the resistance R2, it is possible to increase or decrease the output ultimately desired, such being a function of what the corotron is putting out.

As set forth, the return lead from the corotron to transformer T2 has the series resistor R4. The current through the corotron will be represented as a voltage across this resistor. When coupled with a half-wave rectifier CR3 and filter capacitor C1 across this resistor R4, from point B to point C, the generated DC voltage can be compared with said reference voltage such as the fixed output of DC source P1. Any difference between the feedback rectified DC voltage and the reference would be amplified by operational amplifier OA2 which in turn will control the value of resistor R2 to set up an adjustable series resistance.

Figure 2A:
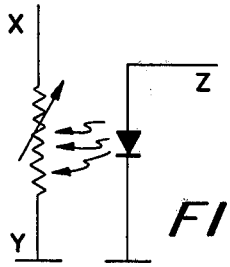

Resistance R2 in FIG. 1 is shown as a block diagram with input X connected to resistor R3, output Y connected to circuit ground, and control input Z connected to the output of operational amplifier OA2. FIG. 2A shows that one embodiment of resistor R2 may comprise a gallium arsenide light emitting diode connected from input Z to circuit ground. Connected to points X and Y would be a selenium type resistor whose resistance value is dependent upon the applied light level, selenium being photoconductive.

Figure 2B:
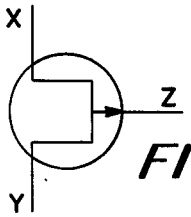
FIG. 2B shows a second alternative embodiment of resistance R2 of FIG. 1 utilizing a field-effect transistor.

FIG. 2B shows another embodiment of resistance R2 as a field-effect transistor. Input X would be connected to the drain electrode, terminal Y connected to the source electrode, while the control input Z would be connected to the gate electrode of the field-effect transistor. This directly coupled field effect transistor would be operated below the knee of its operating curve so that it functions like a resistor where the drain resistance, i.e., the channel resistance through the field-effect transistor and across points X and Y, is a direct function of the gate voltage applied at point Z by virtue of the current supplied by the operational amplifier OA2. In either case the output of operational amplifier OA2 will control the input of this device, which will change the resistance of its main path R2.

If it is desired to have electrical isolation between the primary circuit and the secondary circuit, the device would act as isolation so it is possible to have separate grounds. In that case, it would be preferred to use a light emitting diode as the resistive type of device. If there is to be a common ground it would be less expensive to use a field-effect transistor. Both have been successfully employed.

The operation of the circuit from transformer T1 through transformer T2 is such that if during one half cycle the upper end of T1 is positive, current will flow through diode CR1, through the upper half of the primary winding of transformer T2 through the center tap of T2 back through transistor Q1, resistor R1 to the center tap of T1. On the other half cycle, when the lower end of T1 is positive, current will flow from that point through CR2 to the primary winding of transformer T2 back from the center tap of T2 again through Q1 and R1 to the center tap of T1. In other words, this part of the circuit is a full wave rectifier with a resistor in series with the center tap.

Figure 3:
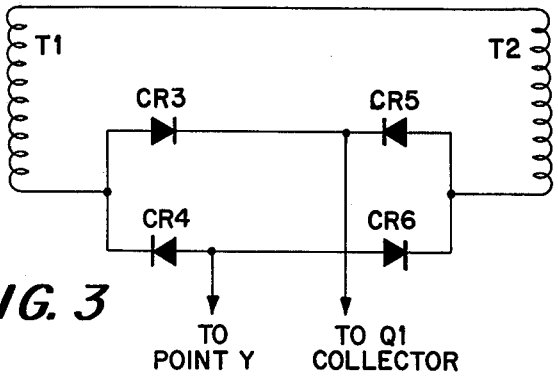
FIG. 3 depicts an alternative embodiment utilizing a bridge rectifier network in lieu of the center tapped transformers.

FIG. 3 shows an alternative embodiment for the two center tapped transformers in FIG. 1. A bridge rectifier circuit comprising diodes CR3, CR4, CR5, and CR6 could be utilized in lieu of the center tapped transformers. Transistor Q1 must have the current flowing to its collector terminal, which can just as effectively be supplied by the bridge circuit. Thus, during the positive part of the input sinusoidal waveform, current would flow from the top terminal of transformer T1, through the input winding of transformer T2 and to the collector of transistor Q1 through diode CR5. Return current would then flow back through diode CR4 to the bottom terminal of transformer T1. During the negative cycle, current would flow from the bottom terminal of transformer T1 through diode CR3 to the collector of transistor Q1, back through diode CR6, through the winding of transformer T2 back to the top terminal of transformer T1.

While the instant invention is herein described as being carried out by specific elements, such are shown for illustrative purposes only and the invention is to be considered broadly within the scope of the appended claims.

What is claimed is:

1. A power supply for generating true sine wave signals comprising:

means for supplying AC current to a load, means coupled to said supplying means for monitoring the amount of current flowing through said load, feedback circuit means coupled to said monitoring means and said supplying means to allow an adjustment of said AC current to said load, said feedback circuit means including variable resistance means for effecting a linear current change in said load to effect said generation of true sine wave signals, said feedback circuit means also including first circuit means coupled between said variable resistance means and said supplying means for adjusting the input supply current to said supplying means, said first circuit means and said variable resistance means comprising a resistance dividing network so that when said variable resistance means is varied the current supplied to said supplying means is varied accordingly, said first circuit means also including an operational amplifier, a pass transistor whose base element is connected to the output of said operational amplifier and whose emitter and collector elements are in series with the supply current to said supplying means, a first resistor connected to said emitter element to complete said series connection to said supplying means, said first resistor-transistor emitter element junction also connected to one input of said operational amplifier, a second resistor connected to the collector of said transistor and the other input of said operational amplifier, this input junction also connected to said variable resistance means, and said operational amplifier, upon change of resistance of said variable resistance means, will cause the ratio of the voltage across said first resistor and said variable resistance means to be constant, and said feedback circuit means also including second circuit means coupled between said monitoring means and said variable resistance means for adjusting the signal applied to said variable resistance means in response to the change in current through said monitoring means.

2. The power supply as set forth in claim 1 wherein said second circuit means comprises:

second operational circuit means coupled to said monitoring means and to a reference voltage source, the output of said second operational circuit being coupled to said variable resistance means, for comparing the voltage signal generated by said monitoring means representative of current flowing therethrough and generating an error signal to said variable resistance means to change its resistance accordingly.

3. The power supply as set forth in claim 2 wherein said variable resistance means comprises:

light emitting diode means for generating a variable light signal in response to the amount of current flowing through said load, and light depending resistance means in close cooperation with said diode means for changing its value of resistance in direct relation to the light output from said diode means.

4. The power supply as set forth in claim 2 wherein said variable resistance means comprises:

field effect transistor means wherein the channel resistance is varied in response to the amount of current flowing through said load.

5. The power supply as set forth in claim 2 wherein said load is a corotron.

6. The power supply as set forth in claim 1 wherein said variable resistance means comprises:

light emitting diode means for generating a variable light signal in response to the amount of current flowing through said load, and light depending resistance means in close cooperation with said diode means for changing its value of resistance in direct relation to the light output from said diode means.

7. The power supply as set forth in claim 1 wherein said variable resistance means comprises:

field effect transistor means wherein the channel resistance is varied in response to the amount of current flowing through said load.

8. The power supply as set forth in claim 1 wherein said load is a corotron.

* * * * *